US012742218B2

(12) United States Patent
Hurtta

(10) Patent No.: US 12,742,218 B2
(45) Date of Patent: Sep. 22, 2026

(54) DIRECT CURRENT ELECTRIC ARC FURNACE

(71) Applicant: Masercata Oy, Turenki (FI)

(72) Inventor: Matti Hurtta, Turenki (FI)

(73) Assignee: Masercata Oy, Turenki (FI)

( * ) Notice: Subject to any disclaimer, the term of this patent is extended or adjusted under 35 U.S.C. 154(b) by 1170 days.

(21) Appl. No.: 17/776,063

(22) PCT Filed: Nov. 15, 2019

(86) PCT No.: PCT/FI2019/050820
§ 371 (c)(1),
(2) Date: May 11, 2022

(87) PCT Pub. No.: WO2021/094646
PCT Pub. Date: May 20, 2021

(65) Prior Publication Data

US 2022/0389529 A1 Dec. 8, 2022

(51) Int. Cl.

| | |
|---|---|
| ***C21C 5/52*** | (2006.01) |
| ***C21C 1/08*** | (2006.01) |
| ***C21C 7/00*** | (2006.01) |

(52) U.S. Cl.
CPC ..... *C21C 5/5229* (2013.01); *C21C 1/08* (2013.01); *C21C 5/5264* (2013.01); *C21C 7/0006* (2013.01); *C21C 7/0025* (2013.01)

(58) Field of Classification Search
None
See application file for complete search history.

(56) References Cited

U.S. PATENT DOCUMENTS

| | | | |
|---|---|---|---|
| 4,079,185 | A | 3/1978 | Collin |
| 4,246,023 | A | 1/1981 | Savov et al. |
| 4,462,878 | A | 7/1984 | Savov et al. |
| 5,410,564 | A | 4/1995 | Takashiba et al. |

(Continued)

FOREIGN PATENT DOCUMENTS

| | | |
|---|---|---|
| CN | 101782321 A | 1/2010 |
| ES | 2009892 | 10/1989 |

OTHER PUBLICATIONS

International Search Report in connection with International Application No. PCT/FI2019/050820, dated Mar. 5, 2020 6 pages.

(Continued)

*Primary Examiner* — Anthony M Liang
(74) *Attorney, Agent, or Firm* — Meunier Carlin & Curfman LLC

(57) ABSTRACT

The invention relates to a method for extracting metal from metal-containing raw material in a batch process by using a direct current electric arc furnace having one or more than one top electrode and at least one bottom electrode, wherein the method comprises the following steps: adding the metal-containing raw material to the furnace, thereby obtaining a loaded bath, moving the top electrode(s) on to the raw material, heating the loaded bath in a heating step by applying direct current through the top electrode(s) to provide an arc to melt the raw material, thereby obtaining molten metal, wherein an average voltage during the heating step is from 20 V to 110 V, and forming solid metal from the molten metal. The invention further relates to a direct current electric arc furnace, a system comprising a direct current electric arc furnace, and a solid metal obtainable by the method.

10 Claims, 7 Drawing Sheets

(56) References Cited

U.S. PATENT DOCUMENTS

| | | | |
|---|---|---|---|
| 9,611,520 | B2 | 4/2017 | Deegan et al. |
| 2002/0136260 | A1 | 9/2002 | Ma |
| 2014/0033866 | A1 | 2/2014 | Yuxin et al. |
| 2022/0286036 | A1 | 9/2022 | Zhang et al. |

OTHER PUBLICATIONS

Written Opinion of the International Searching Authority in connection with International Application No. PCT/FI2019/050820, dated Mar. 5, 2020. 8 pages.
Extended search report from European Patent Office for corresponding application EP 19952194, dated on Mar. 27, 2023, 11 pages.
Office action and English translation thereof issued on corresponding application CN2019801022371, mailed on Sep. 23, 2023, 20 p.

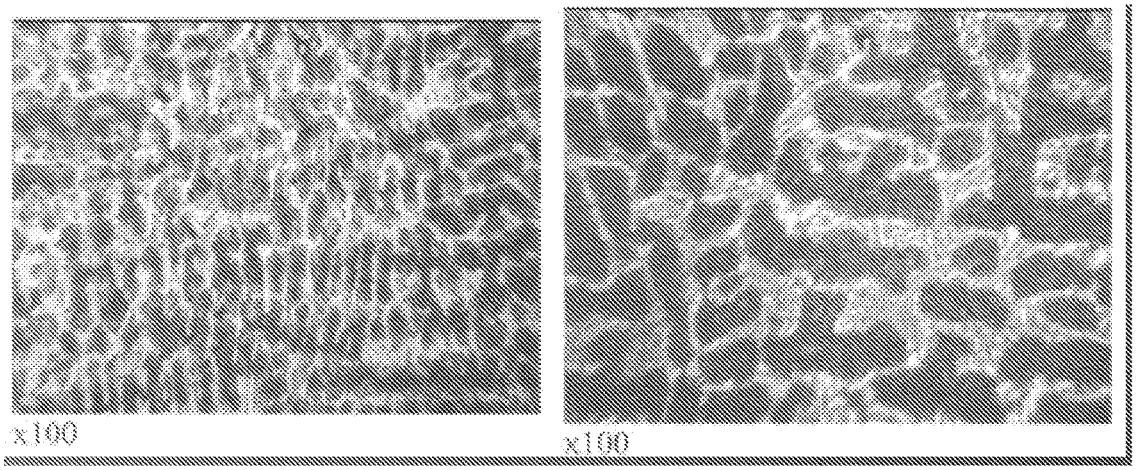
microstructure of a novel metal sample
Fig. 6a
microstructure of a conventionally manufactured metal sample
Fig. 6b
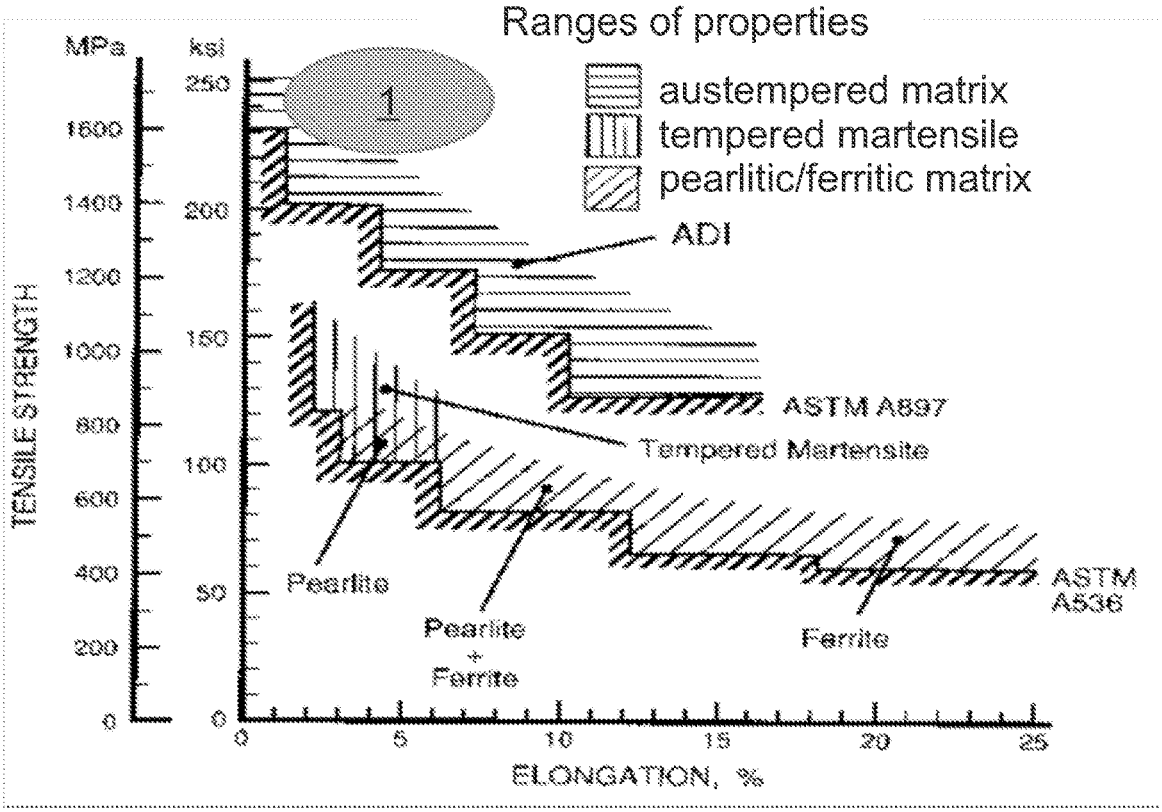
Fig. 6c

DIRECT CURRENT ELECTRIC ARC FURNACE

CROSS REFERENCE TO RELATED APPLICATIONS

This application is a United States National Phase Patent Application of International Patent Application Number PCT/FI2019/050820, filed on Nov. 15, 2019, the content of which is incorporated herein by reference.

TECHNICAL FIELD

This invention relates to a direct current electric arc furnace (DC-EAF) for manufacturing metals. This invention further relates to a method and system for manufacturing metals. This invention further relates to metals.

BACKGROUND

Electric arc furnaces are furnaces that use electric arc for heating charged material. Electric arc furnaces are typically used for manufacturing steel or other metals.

In arc furnaces, metallic raw material is directly exposed to an electric arc. Thus, the current in the furnace passes through the charged material. It is known that arc furnaces are not same nor working with same principles as induction furnaces.

There are mainly two types of electric furnaces; direct current (DC) electric arc furnaces and alternating current (AC) electric arc furnaces.

SUMMARY

This invention relates to a direct current (DC) electric arc furnace (EAF). Aspects of the invention are characterized by what is stated in the independent claims. Preferred embodiments are disclosed in the dependent claims. These and other embodiments are disclosed in the description and figures.

The DC electric arc furnace can be used for melting ferrous and non-ferrous metals, such as various alloys of steels, cast irons, aluminum and alloys on its basis, copper and alloys on its basis, copper waste and ferroalloys.

A method for extracting metal from metal-containing raw material in a batch process by using a direct current electric arc furnace having one or more than one top electrode and at least one bottom electrode can comprise the following steps:

- adding the metal-containing raw material to the furnace, thereby obtaining a loaded bath,
- moving the top electrode(s) on to the raw material,
- heating the loaded bath in a heating step by applying direct current through the top electrode(s) to provide an arc to melt the raw material, thereby obtaining molten metal,
- wherein an average voltage during the heating step is from 20 V to 110 V, and
- forming solid metal from the molten metal.

Thanks to the present invention, novel metals having improved properties may be obtained. Further, the novel method may be gentle to the arc furnace, thus, refractory materials of the furnace may be in good condition even after 3 months.

The method can further comprise

- adding aluminum to the molten metal before forming the solid metal,

- heating the aluminum, thereby obtaining an aluminum containing molten metal, and
- forming the solid metal from the aluminum containing molten metal.

Thus, thanks to the novel solution, it can be possible to obtain aluminum containing solid metal from metal scrap by adding some aluminum to the furnace.

The method can further comprise the following steps:

- analyzing aluminum content from the molten metal, and
- adjusting aluminum content of the molten metal by using the analyzed result.

The method can comprise a step, wherein from 0.2 wt. % to 30 wt. %, preferably from 0.3 wt. % to 0.7 wt. % aluminum is added to the molten metal, calculated from total mass of the raw materials on the melt.

Further, the method can comprise a step, wherein from 5 wt. % to 30 wt. %, preferably from 8 wt. % to 20 wt. % aluminum is added to the molten metal, calculated from total mass of the raw materials on the melt. Thus, it is possible to obtain ferroaluminum.

The voltage can be from 50 V to 100 V more than 70% of duration of the heating step. Further, the voltage can be from 60 V to 90 V more than 70% of duration of the heating step. Thus, quite low voltage can be used to obtain solid metals, hence, properties of the obtained metals can be improved.

The first top electrode can have, at least part of the time, a speed from 5 m/min to 20 m/min, more preferably from 10 m/min to 15 m/min. Further, the furnace can have a second top electrode which can have, at least part of the time, a speed from 5 m/min and 20 m/min, more preferably from 10 m/min to 15 m/min.

Therefore, the direct current electric arc furnace can comprise a first top electrode having a first speed and a second top electrode having a second speed. The first speed can differ, at least part of the heating time, from the second speed. In addition, or alternatively, the first location of the first to electrode can differ, at least part of the heating time, from the second location of the second top electrode. Thus, it can be possible to control efficiently the process. Thus, metals having improved structure and properties can be obtained.

Therefore, the method can comprise the following step:

- controlling a temperature level of the heating step by moving the first top electrode with the first speed differing from the second speed of the second top electrode.

A carbon content of the manufactured solid metal can have an effect on the properties of said solid metal. The carbon content of the melt and the obtained solid metal can be controlled. In an embodiment, a carbon content of the melt can be equal or less than 0.01%, preferably equal or less than 0.002%.

The method can comprise a step, wherein from 0.2 wt. % to 15.0 wt.-% carbon and/or from 0.2 wt. % to 15.0 wt.-% graphite is added to the metal containing raw material before forming the solid metal. Preferably, from 1.0 wt. % to 3.5 wt.-% carbon and/or from 1.0 wt. % to 3.5 wt. % graphite is added to the metal containing raw material before forming the solid metal.

The metal containing raw material can comprise at least 5 dry wt. % metals. Preferably, the metal containing raw material comprises metal(s) equal to or more than 10 dry wt. %.

The novel solution can be used to handle difficult waste material, such as finely dispersed waste material comprising metal(s). Thus, the metal containing raw material can comprise at least 50 dry wt. % finely dispersed metal containing raw material having a particle size equal to or less than 1 mm.

Moreover, the novel solution can be used to obtain solid metals from red mud. The metal containing raw material can comprise red mud at least 40 dry wt. %, preferably equal to or more than 50 dry wt. %. The red mud preferably comprises iron (Fe) from 20 wt. % to 55 wt. %, calculated as dry weight of the red mud.

Furthermore, in an embodiment, at least 80 wt. % of scandium and titanium is separated from the red mud into slag. This can be done, for example, by using at least two top electrodes having speeds equal to or more than 5 m/min and by using voltages equal to or less than 110 V.

The metal containing raw material can comprise at least 5 wt. % metals, preferably at least 20 wt. % metals, more preferably at least 30 wt. % metals and most preferably at least 50 wt. % metals. The metal containing raw material can comprise metals up to 100 wt. %. The more the raw material comprises the metals, the more efficient the novel process can be.

Preferably, the metal containing raw material comprises at least 30 dry wt. % iron (Fe), for example from 30 wt. % to 99 wt. % iron (Fe), calculated as dry weight of the metal containing raw material.

The metal containing raw material can be suitable to process pyrite cinder generated during the processing of iron pyrites. Thus, the metal containing raw material can comprise at least 50 wt. %, for example from 50 wt. % to 70 wt. % pyrite cinder. This can be done, for example, by using at least two top electrodes having speeds equal to or more than 5 m/min and, preferably, by using voltages equal to or less than 110 V.

Thanks to the novel invention, the metal containing raw material can have a moisture content up to 20%, even up to 25%. Thus, the metal containing raw material can have a moisture content between 0% and 25%, for example from 5% to 20%.

Thanks to the novel solution, it is possible to obtain ferronickel from nickel containing waste material. Thus, in an embodiment, the obtained metal is a ferronickel and the metal containing raw material comprises at least 40 wt. %, for example from 40 wt. % to 70 wt. % nickel-containing sludge and/or Ni—Fe and/or Ni—Cd battery lamellas.

In an embodiment, the metal containing raw material can comprise at least 40 dry wt. % waste from metallurgical and steel production.

The novel direct current electric arc furnace for melting raw material comprising metal(s) can comprise

- a bottom of the furnace, which is shaped to have upward sides so that at least a portion of said raw material is maintained centrally thereon,
- one or more than one top electrode,
- a closable roof through which the top electrode(s) pass,
- a direct current power source, and
- means for electrically conducting the direct current from said power source to said raw material.

One or more than one top electrode can extend downwardly to form an arc between the top electrode(s) and said raw material, which top electrode(s) operates as a cathode, and which top electrode(s) can be positioned vertically above the surface of said raw material and spaced from said raw material. Each top electrode can be configured to operate within a low voltage range from 20 V to 110 V, and each top electrode can have an autonomous moving speed.

A novel system can comprise

- the DC electric arc furnace comprising one or more than one top electrode, wherein each top electrode can have an autonomous moving speed,
- a control unit,
- at least five transformer units to provide the electrical supply to the electrode(s), and
- a rectifier unit for converting alternating current to direct current.

A novel solid metal can be obtainable according to the novel method. The novel solid metal can have a microstructure of at least 85% of martensite. Furthermore, it can have a tensile strength equal or more than 600 MPa, more preferably equal or more than 1200 MPa, and most preferably equal or more than 1400 MPa. Furthermore, the novel solid metal can comprise at least 30 wt. % Fe. Still further, the novel solid metal can have an HRC hardness value e.g. from 50 to 60.

In an embodiment, the solid metal comprises Fe-AL-C carbides. This structure can improve properties of the solid metal.

The metal can have an aluminum content from 0.2 wt. % to 0.5 wt. %. Alternatively, the metal can have an aluminum content from 8 wt. % to 20 wt. %. The aluminum can improve the properties of the metal.

The obtained solid metal can comprise a microstructure comprising at least 90% of martensite. This microstructure can have very good strength properties.

In an advantageous embodiment, the solid metal is a cast iron having improved properties, i.e., a super cast iron. In another advantageous embodiment, the solid metal is a cast steel having improved properties, i.e., a super cast steel.

Thus, the novel solution may be used for solving the global problem of utilization of metallurgical industrial wastes—red muds, pyrite cinders, nickel-containing slags and copper-containing sludges, iron scales, chromite sands waste, gas cleaning of steel-making and metallurgical furnaces, electronic crowbars—industrially.

Thanks to the present invention, it can be possible to carry out the melting of industrial wastes right on the sites of their utilization, getting a market product in the form of steel or cast iron ingots, slabs, copper billets, ferrovanadium, ferromolybdenum, ferro-tungsten, ferroaluminum, ferronickel, alloyed steels and alloyed cast iron at the exit of the furnace. At the same time, the recycling process can take place without causing similar harm to the environment as with typical solutions. Further, the novel solution can be used to dispose finely dispersed waste, which fundamentally cannot be recycled in classic furnaces of existing structures.

BRIEF DESCRIPTION OF THE DRAWINGS

FIGS. 6*a*-6*c* show some results from experimental tests, wherein FIG. 6*a* shows a microstructure of a metal sample manufactured according to the invention, FIG. 6*b* shows a microstructure of a conventionally manufactured metal sample, FIG. 6*c* shows tensile strength ranges and elongation ranges of tested cast iron samples from experimental tests vs. conventional ranges.

Figure 1:
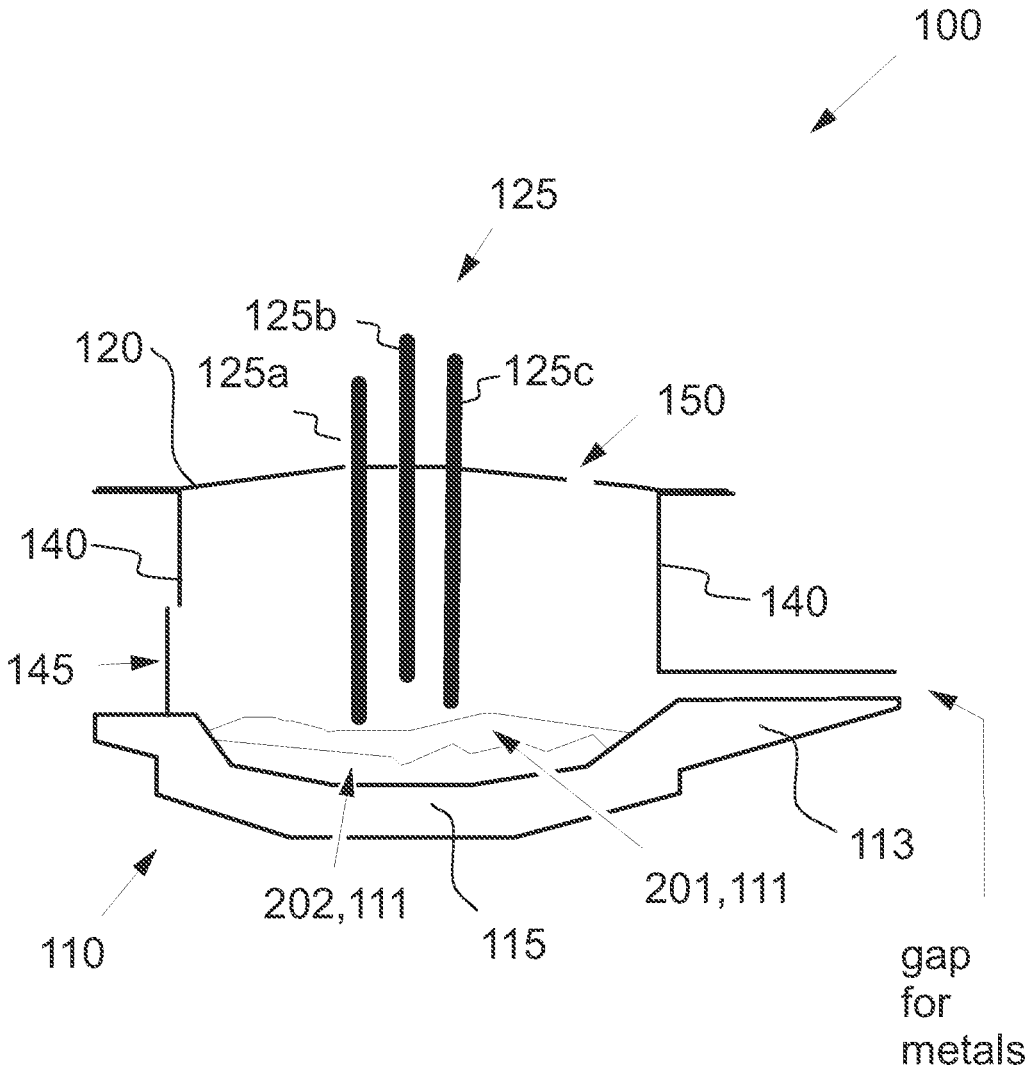
FIG. 1 illustrates an example of a general principle of a DC electric arc furnace.
Figure 2A:
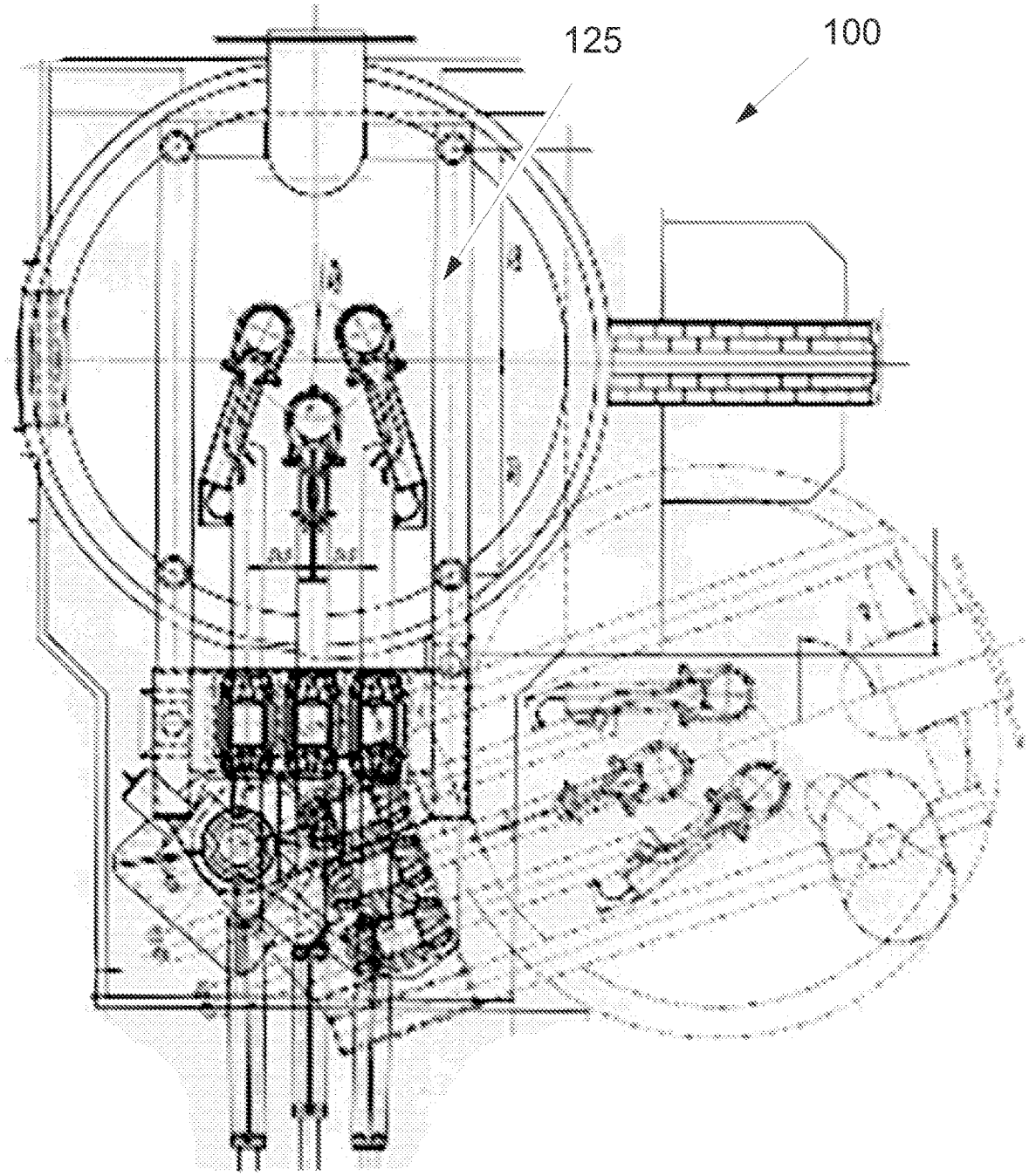
FIG. 2*a* illustrates an example of a DC electric arc furnace, shown above, FIG. 2*b* illustrate a detailed example of a DC electric arc furnace, in scale.
Figure 2B:
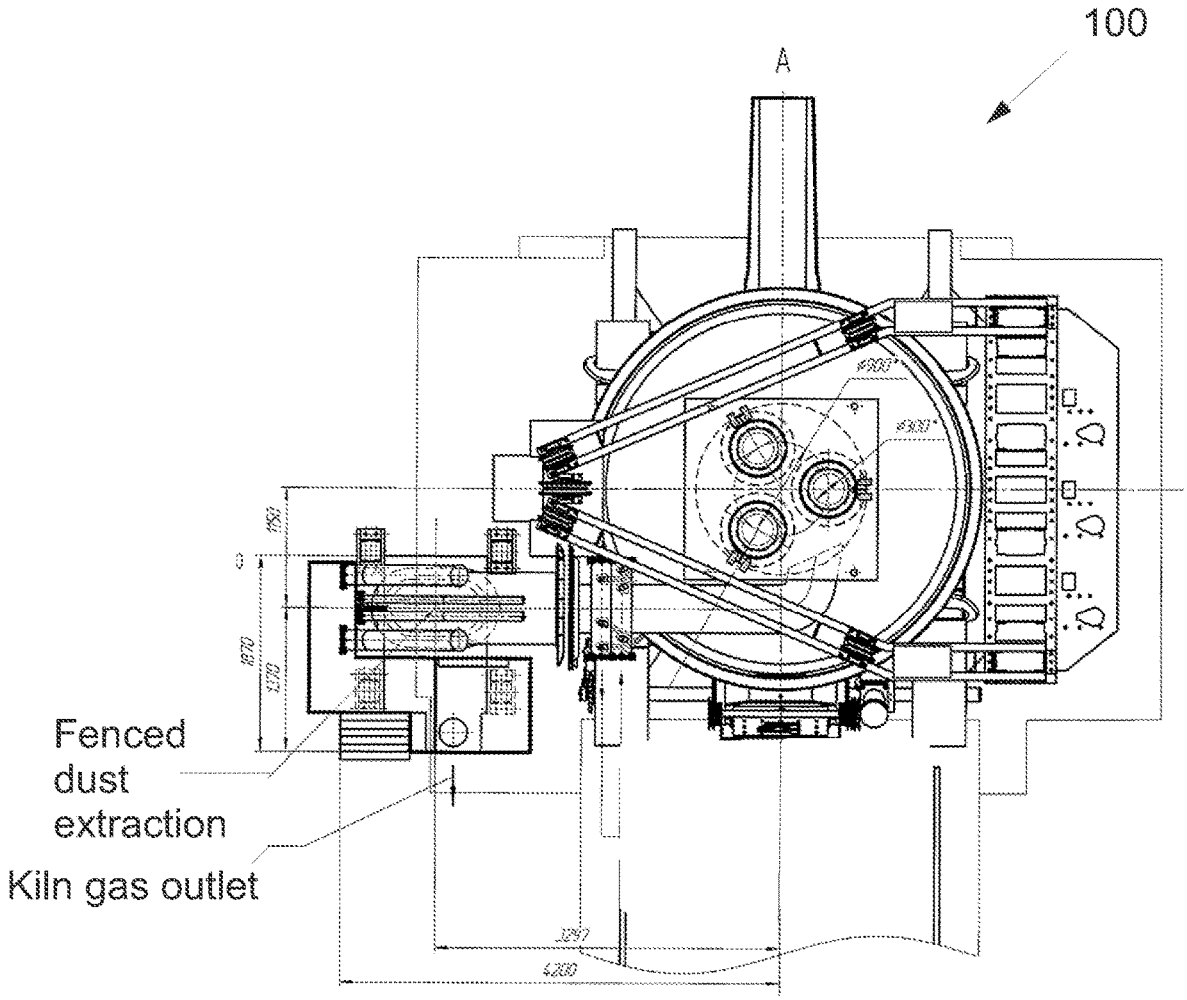
Figure 3:
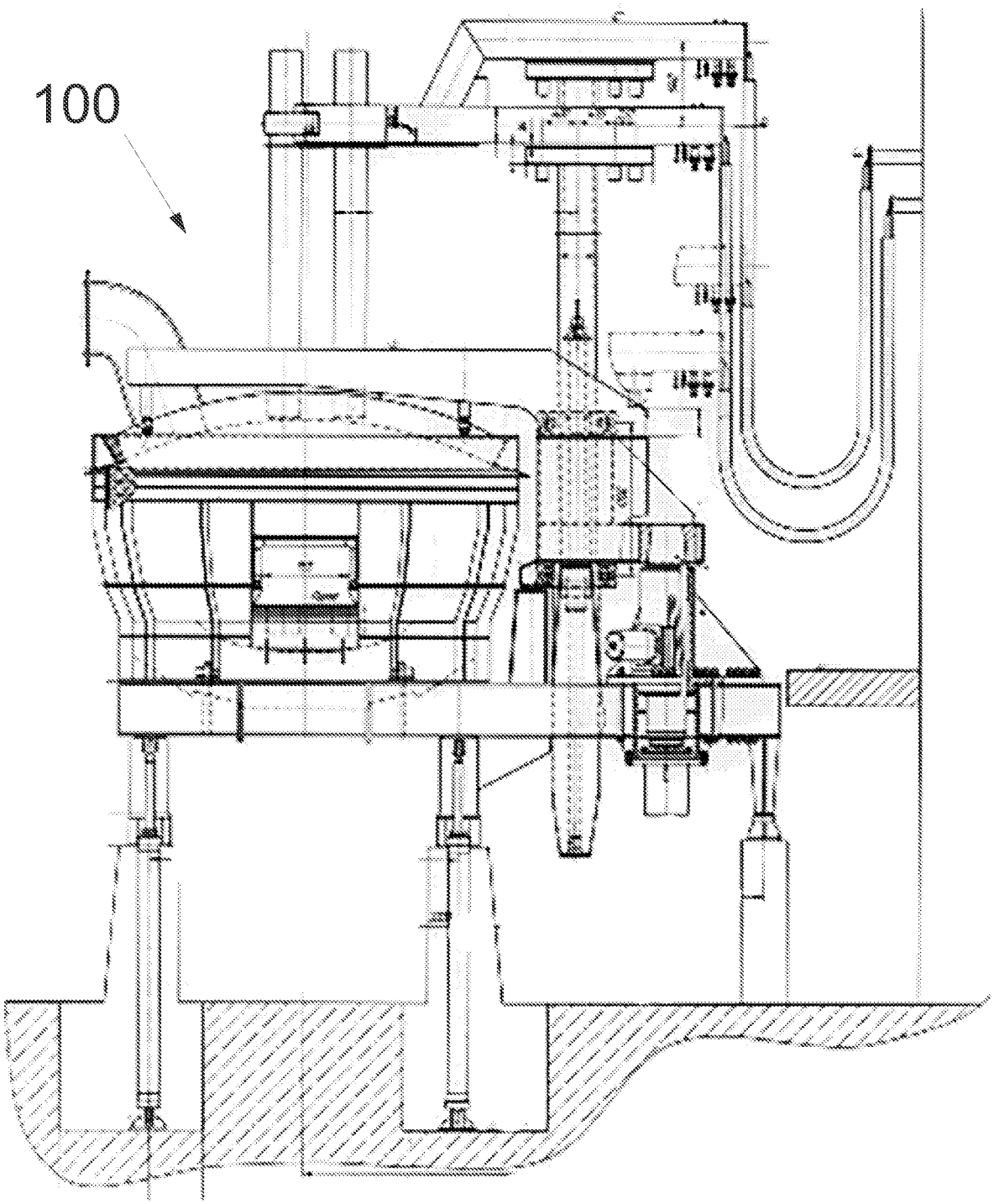
FIG. 3 illustrates an example of a side view of a DC electric arc furnace.
Figure 4:
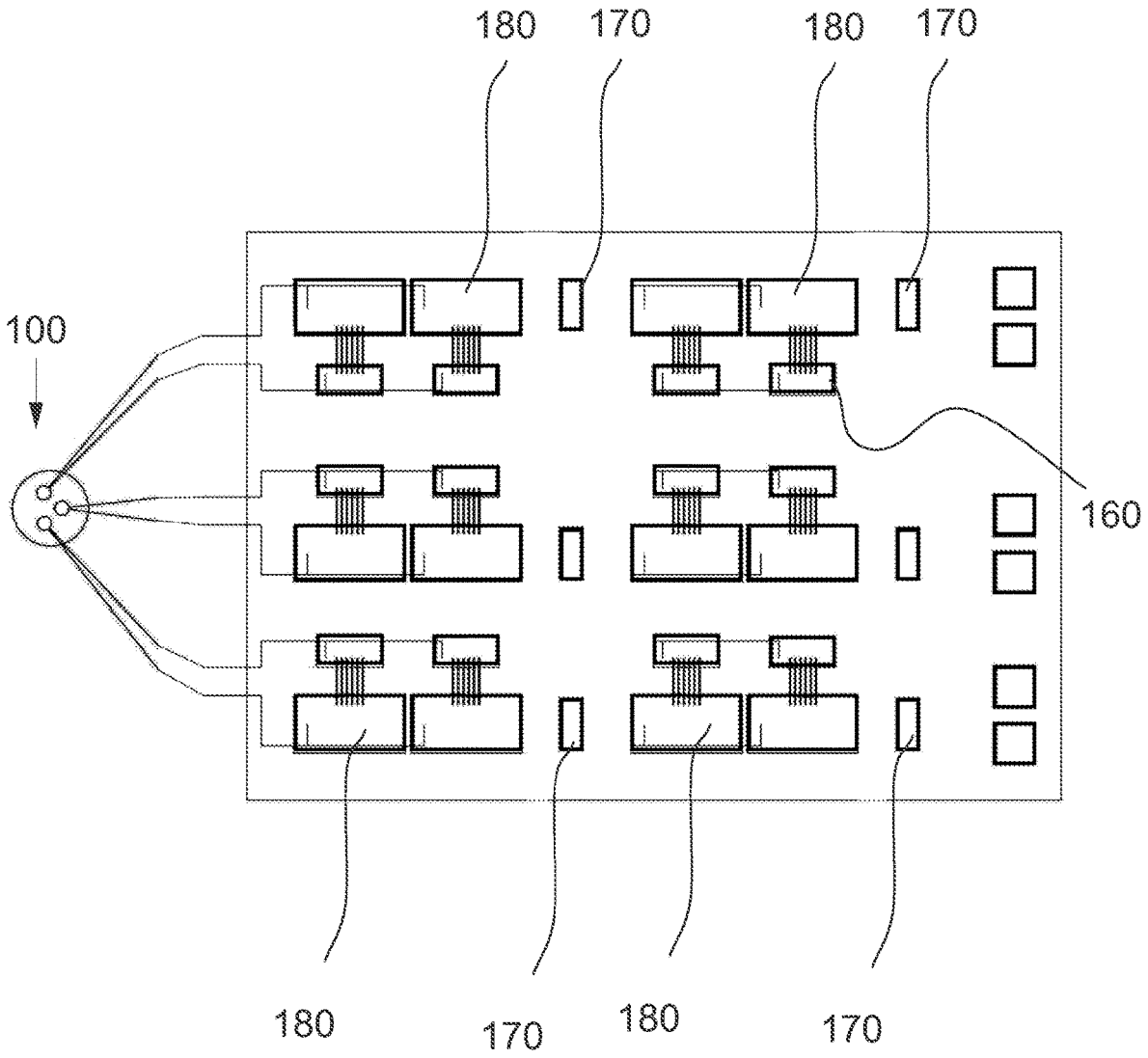
FIG. 4 illustrates an example of a system comprising a DC electric arc furnace.
Figure 5A:
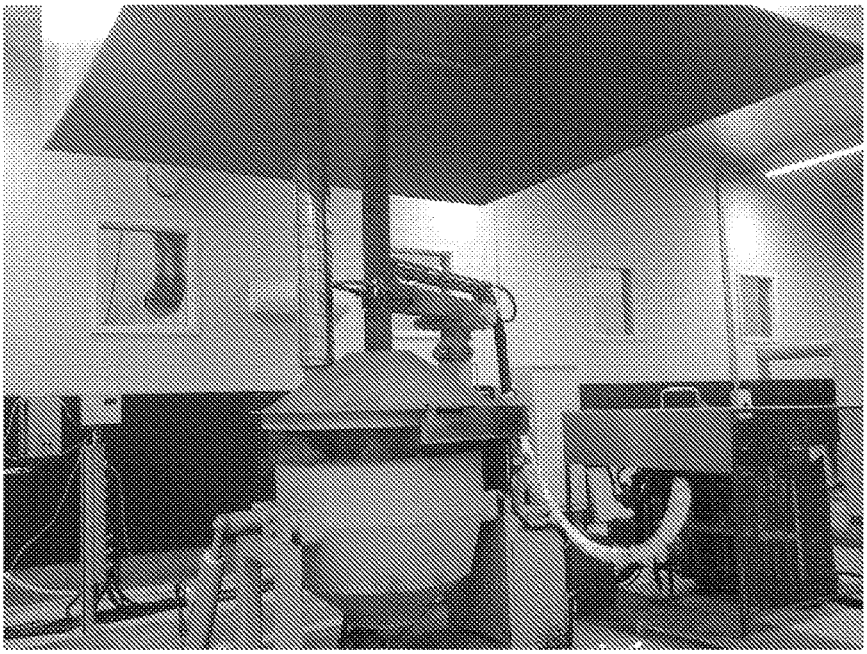
FIGS. 5*a-c* show some photos taken during experimental tests.
Figure 5B:
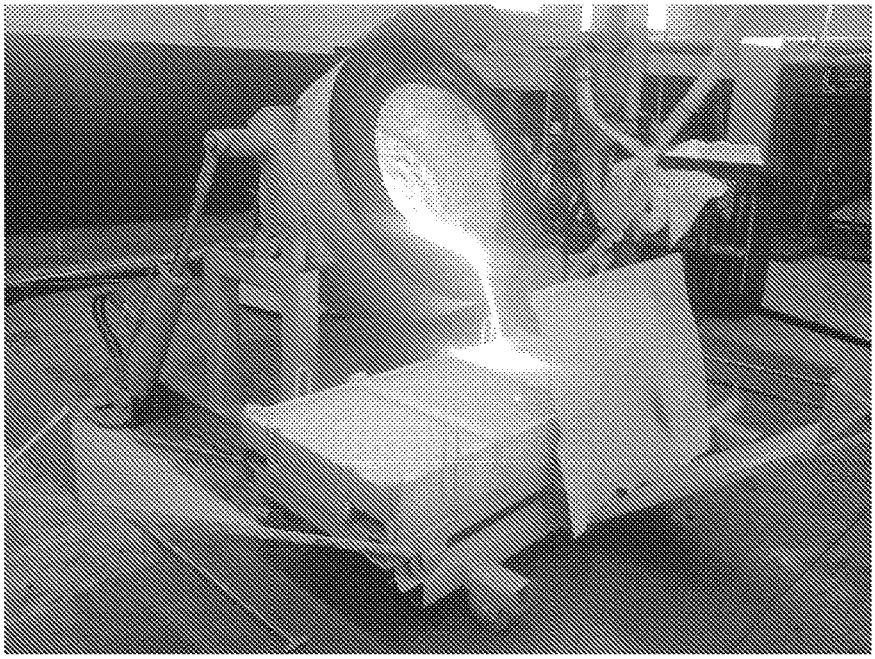
Figure 5C:
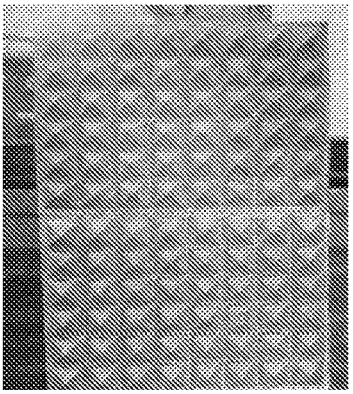

The Figures are intended to illustrate the general principles of the disclosed solution. Therefore, the illustrations in the Figures are not necessarily in scale or suggestive of precise layout of system components.

DETAILED DESCRIPTION

In the text, references are made to the Figures with the following numerals and denotations:

1 cast iron manufactured according to the invention,
100 direct current electric arc furnace, i.e. DC-EAF,
110 base of the furnace,
111 melting bath of the furnace,
113 a hearth of the furnace,
115 bottom electrode, i.e., anode,
120 roof, i.e. a curved cover,
125 top electrode, i.e., cathode,
125*a* first top electrode,
125*b* second top electrode,
125*c* third top electrode,
140 side walls,
145 door for slag removal,
150 gas outlet,
160 rectifier, i.e., a rectifier unit,
170 reactor for limiting current, i.e. current-limiting reactor,
180 transformer unit,
201 slag, and
202 molten metal.

In this application, the term "electric arc furnace" refers to electric arc furnaces, which differs hugely from induction furnaces. In the novel solution, the electric arc furnace is a direct current electric arc furnace.

In this application, the term "DC electric arc furnaces" as well as the term "furnace" refers to direct current electric arc furnaces. The direct current electric arc furnaces are not same, nor working with same principles, as AC electric arc furnaces.

In this application, the term "martensite" refers to a very hard form of metal crystalline structure. This term is known by a person skilled in the art. The novel metal, e.g. the novel cast iron, can have a microstructure comprising equal or more than 85% martensite, typically equal or more than 90% martensite, right after the solid metal is formed.

In the DC electric arc furnace, current flows from one or more than one top electrode 125, 125*a*, 125*b*, 125*c*, i.e., cathode(s), to at least one bottom electrode 115, i.e., anode(s).

The bottom electrode can be a metal anode, which is placed at the bottom. The bottom electrode(s) 115 can be embedded at the bottom of the furnace. There are different methods for fixing the bottom electrode 115 (i.e., the anode) at the bottom of the furnace 100. These methods are known by a skilled person.

The DC electric arc furnace 100 can comprise at least one bottom electrode 115. The bottom electrode(s) 115 is/are preferably coolable, because otherwise the bottom electrode(s) may get heated up fast when the furnace is melting raw materials. Thus, the bottom electrode(s) 115 can be, for example, water cooled or air cooled. Cooling with water or other fluid can be more efficient than cooling with air.

In this application, the term "metal casting" refers to solid metal objects produced by filling the void within a mold with liquid metal.

In this application, the term "cast iron" refers to a ferrous alloy having a carbon content of more than 2%.

In this application, the term "cast steel" refers to a ferrous alloy with a maximum carbon content of 2%, preferably the carbon content is less than 1%, most preferably from 0.1% to 0.5%.

In this application, the term "metallic" refers to material comprising at least 5 dry wt. % metals, preferably at least 30 dry wt. % metals. Particularly, the term "metallic raw material" refers to raw material(s) comprising equal to or more than 5 dry wt. % metals, preferably equal to or more than 30 dry wt. % metals.

In this application, the term "red mud" refers to bauxite tailings, also known as red sludge or alumina refinery residues. The red mud is typically waste material coming from a process wherein bauxite is converted to alumina. Iron oxide content in the red mud typically varies between 35 wt. % and 50 wt. %.

According to the novel method, the red mud can be used as a raw material to obtain high quality metals. For example, FA10 Steel, manufactured according to the novel solution mainly from the red mud, can have low gas saturation.

The novel solution is based on a direct current electric arc furnace using low voltages together with high speed(s) of the top electrode(s). The novel solution can reduce the negative impact of the operation on the furnace.

The novel solution can use high current values on the feeding power net and create trouble-free operation conditions with increased values of power factor. Further, an electric efficiency can be improved with single overloads during roughly 0.6 seconds with peak current values of up to 40 kA.

Further, the novel process may create a short working DC arc, e.g. with a length from 0.2 mm to 13 mm during the heating step, when the DC arc is heating the material. Further, there can be a large direct current from 1.0 to 10 kA.

Thanks to the novel process, it is possible to obtain a decrease in the amount of energy supplied by at least 14%, while improving the furnace productivity up to 20%. This can lead to a reduction in melting time and consumption of all consumables—graphite electrodes as well as refractory materials.

The emissions of harmful substances into the environment can be even tens percent lower compared to conventional electric arc processes.

The novel method allows to reach the melting temperature in a shorter period, typically 20% faster, in comparison with conventional DC electric arc furnaces.

After loading the raw materials into the furnace, an initial voltage with a current strength of 1.0 kA can be supplied to the arc. As the raw materials melt and the arc begins to operate stably, the current strength can be increased up to 10 kA, e.g. from 5 kA to 10 kA, until roughly 60-70% of the raw materials has melted in the furnace. As the raw material melts, the current is regulated.

The current can be, for example, 1) around 1.0 kA—the beginning of the melting (approximately the first third part of the smelting)—up to 10 minutes;
2) from 5.0 kA to 7.0 kA (second third part of the smelting)—up to 20 minutes);
3) from 7.0 kA to 10.0 kA (third and the last part of the smelting)—up to 15 min.

All the above-mentioned times can be adjusted as needed.

Advantageously, the furnace operates at an average current from 5.5 kA to 8.5 kA. Typically, the current is reduced to minimum values before the manufactured molten metal is discharged from the furnace.

The energy input for the novel casting process can be reduced. Further, the novel short arc casting process can use low voltages from 20 V to 110 V, more preferably from 25 V to equal to or less than 100 V. This can improve a quality of the manufactured product. According to another embodiment, the voltage can be from 20 V to 90 V. By using a process having a maximum voltage equal to or less than 90 V, the quality of the manufactured product may be improved compared to the solution in which voltage can be higher.

A system comprising a DC electric arc furnace 100 can comprise the DC electric arc furnace 100 comprising electrodes 125, 115,
a control unit,
at least five transformer units 180,
a rectifier 160,
a reactor for limiting current 170,
preferably an oil station, and
preferably a water unit.

A control unit of the DC electric arc furnace 100 is used to control operation of the DC electric arc furnace.

The transformer unit 180 can provide the electrical supply to the electrode(s) 125. The current power can be conveyed from the transformer unit 180 to the top electrodes 125. The transformer unit 180 can be an oil-filled, water-cooled unit.

The at least five transformer units 180 can perform a voltage regulation in lower areas than a transformer unit for the classical DC electric arc furnaces. This can ensure a high degree of extraction of metals from iron-containing oxide raw materials containing nonmetallic inclusions, e.g. up to 70%, without any need of further processing. Further, this can increase the speed of extraction of metals.

The system can comprise several transformers 180, e.g. at least five transformer units, to provide electrical supply to the electrodes 125. Preferably the system comprises at least 6 transformer units, such as from 6 to 16 transformer units 180. More preferably, the system comprises from 10 to 14 transformer units 180 to provide the electrical supply needed for the novel solution.

A rectifier is an electrical device that can convert alternating current to direct current, which flows in only one direction.

The system can comprise several rectifier units 160, e.g. at least three rectifier units, preferably from 6 to 16 rectifier units 160 to provide the direct current needed for the novel solution. Preferably, the system comprises from 10 to 14 rectifier units 160.

The system can comprise several reactors 170 for limiting current. Preferably, the system comprises three or more than three reactors 170 for limiting current, such as from 3 to 8 reactors 170 for limiting current, or from 4 to 7 reactors 170 for limiting current.

The DC electric arc furnace 100 can comprise a heart 113,
a roof 120,
side walls 140,
one or more than one top electrode 125, and
at least one bottom electrode 115.

The DC electric arc furnace 100 can have a mechanism for moving the top electrode(s). The system comprising the DC electric arc furnace 100 preferably comprises positioning system for top electrodes 125, which positioning system can be configured to raise and lower each of the electrodes automatically.

The DC electric arc furnace operates as a batch melting process producing batches of molten metals. Thanks to the novel solution, it can take less than two hours, most often around 1 hour, to manufacture one batch from the metal containing scrap to metal(s).

Graphite can be used as material for the top electrode(s) 125. Thus, the top electrode(s) 125 are preferably graphite electrode(s). The graphite has high electric conductivity. Therefore, the graphite electrodes can have improved electric conductivity compared to other materials. However, in some cases carbon electrodes may be used instead of the graphite electrodes.

The DC electric arc furnace 100 can comprise a hole(s) in the roof 120. Thus, a passage for each top electrode can be provided. The roof 120 can comprise one hole for each top electrode, through which the electrode(s) can be inserted.

The roof 120 can comprise a roof retraction mechanism for the electrode removal and furnace 100 charging. The charging of the DC electric arc furnace 100 can take place by swinging the roof 120 of the furnace 100. Thus, the furnace 100 can be easily charged with raw materials. Further, thanks to the roof retraction mechanism, each electrode 125 can be removed and changed when needed. The roof 120 can comprise, for example, alumina and/or magnesite-chromite. The roof structures are known by a person skilled in the art.

After charging the DC electric arc furnace 100 with metallic raw material, the top electrode(s) 125 can be moved down on to the metallic raw material. The distance between the top electrode(s) 125*a*, 125*b*, 125*c* and a surface of the metallic raw material can be short. Further, low voltages can be used. The novel arc process can be easy for the furnace, if compared conventional techniques, hence, a maintenance cycle can be improved.

After charging the DC electric arc furnace 100 with the metallic raw material, the arc can be produced for melting down the raw material. Thus, the DC electric arc furnace 100 can be configured to produce the arc for melting down the raw material comprising metal. Preferably, the melting process, i.e. the heating process, uses a voltage between 20 V and 100 V. This voltage level can cause improved metal purity. Further, the produced metal can have a high quality due to said high metal purity.

Preferably, the roof 120 comprises an outlet 150 for gas/air. Alternatively, or in addition, there may be an outlet 150 for gas/air between the roof 120 and a side wall 140.

During the melting process, at least some slag 201 is typically formed. Therefore, the method for manufacturing metals preferably comprises a step wherein at least part of the slag 201 is removed. The slag 201 is typically removed before the molten metal 202 is ready for tapping. Thus, the system comprising the DC electric arc furnace can be configured to remove at least part of the slag 201.

The whole heating step, from the producing the arc to obtain the molten metal 202 ready for tapping can take from 30 minutes to 100 minutes, preferably equal to or less than 80 minutes.

The DC electric arc furnace 100 comprises the base 110 of the furnace. The base can have highly fireproof lining such that a heart of the furnace is formed.

The DC electric arc furnace can further comprise a door 145. Thus, the slag removal step can be done from the surface of the melting bath 111 through the door 145.

The DC electric arc furnace 100 can comprise a tilting mechanism that can be used to pour the metal that is molted to a mold by shifting the DC electric arc furnace 100. Thus, the method for manufacturing metals can comprise a step wherein molted metal 202 is poured down to a mold.

The tilting mechanism of the furnace 100 can comprise a tilt cylinder, preferably mounted to the base 110. The tilt cylinder can be used for inclination of the heart 113 of the furnace. This can ensure the discharge of the molted metal. The tilt cylinder is preferably a hydraulic cylinder.

The heart 113 is typically framing the melting bath 111. The heart 113 can comprise two rotary axles on the upper part of the casing for the inclination of the heart 113.

The DC electric arc furnace 100 comprises one or more than one bottom electrode 115. The bottom electrode(s) 115 works as an anode. The bottom electrode(s) 115 can be coolable, preferably the bottom electrode 115 is a water-cooled electrode. The bottom electrode 115 can be fixed to the lower part of the casing, typically through insulating gaskets.

The DC electric arc furnace 100 can comprise a mechanism for lifting and turning the roof 120. Preferably the mechanism for lifting and turning the roof 120 comprises a hydraulic cylinder. Thus, the roof 120 can be withdrawn, when needed. The roof 120 can comprise a ring to support the furnace roof 120. Said ring can be hollow, water-cooled ring, preferably having a conical inner wall.

The metallic raw material can be melted in the melting bath 111. The roof 120 can close the melting space. The tilt of the melting bath 111 as well as the lifting and rotation of the roof 120 can be controlled. Further, the tilting of the heart 113 (the melting bath 111) is preferably prevented if the roof is not raised.

The DC electric arc furnace 100 preferably comprises an electrode holder for the top electrode(s). The electrode holder can be used for supplying current to the top electrode(s). Further, the electrode holder can be used for movement of the top electrode(s) during the melting process.

As discussed above, the DC electric arc furnace 100 can comprise a water-cooling system. The water-cooling system can comprise a pumping station and hoses and pipes for supplying water to the DC electric arc furnace. Cooling supply, such as the water supply, needs to be uninterrupted during the usage of the DC electric arc furnace 100.

The novel DC electric arc furnaces 100 can comprise one or more than one top electrode 125, preferably graphitized electrode(s). Advantageously, the DC electric arc furnace 100 comprises two or more than two top electrodes, such as 2 or 3 top electrodes. Most advantageously, the plasma DC electric arc furnaces 100 comprises three top electrodes 125. Each top electrode 125 can be movable. Advantageously, each top electrode is arranged to move automatically. The movement of the electrode(s) can be controlled by a control unit.

The top electrode(s) 236 can move substantially freely in the vault hole(s), within predetermined range. A diameter of the top electrode(s) 125, 125*a*, 125*b*, 125*c* can be, for example, from 100 mm to 500 mm.

Advantageously, each top electrode 125 can be moved independently, regardless of speed of other top electrodes. Thus, each top electrode 125 can be independently movable. Thanks to the top electrodes 125 that can be moved independently and not simultaneously with other top electrodes, the process can be easily controlled. Thus, properties of the obtained product can be improved.

Therefore, each top electrode 125 preferably has an autonomous speed and, hence, location. Particularly, the moving speed can differ between top electrodes. This can, not only improve properties of the obtained the product, but also increase the electrical efficiency of the furnace. Speed of at least one top electrode, preferably all top electrodes, can be configured to be, at least mostly, between 8 and 17 m/min, more preferably from 10 m/min to 15 m/min. Thus, an average speed of top electrode(s) 125 during the heating step can be between 8 and 17 m/min, more preferably from 10 m/min to 15 m/min. Thus, a first top electrode 125*a* can be configured to move at a first speed, and a second top electrode 125*b* can be configured to move at a second speed, wherein the first speed and the second speed can differ from each other at least part of the time during the heating step. Thus, a highly controlled temperature as well as high process stability can be provided.

The novel solution can also be used to process fine and moist raw materials. The metallic raw material can comprise finely dispersed metal containing raw material(s). The finely dispersed metal containing raw material(s) refers to materials, wherein

- at least 50 wt. % of particles, preferably at least 70 wt. % of particles have a particle size equal or less than 1 mm, and
- the metal content is equal to or more than 5 wt. %, preferably equal to or more than 30 wt. %.

The novel solution can be very effective, hence, the amount of non-metallic material in the raw material can be up to 70 wt. %, or in some cases even up to 95 wt. %.

The novel solution can be particularly suitable for manufacturing metals mainly from red mud (bauxite tailings). Red mud has been problematic waste material. Typically, more than 100,000,000 metric tons of red mud should be handled every year, thus, this is a great problem. Thanks to the novel solution, a metal having good properties can be manufactured mainly from the red mud. Further, the red mud may contain about 20% water, which water as well as most of the metals can be recovered, thanks to the novel solution. Further, thanks to the novel solution, moisture content of the metallic raw material can be up to 18%, typically even up to 22%, and in some cases even up to 25%, and the metallic raw material can still be processed without a separate drying step.

The method for manufacturing a metal comprising red mud as metallic raw material can comprise the following steps:

- adding metal containing raw material comprising
  - from 10 wt. % to 30 wt. % iron (Fe)
  - from 0.5 wt. % to 1.5 wt. % carbon (C), and
  - from 0.5 wt. % to 1.5 wt. % graphite
  - from 0.5 wt. % to 1.5 wt. % sand
- to the DC electric arc furnace 100
- applying direct current through the at least one top electrode to provide an arc to melt the metal containing raw material,
- melting the metal containing raw material,
- removing at least part of the formed slag 201,
- optionally, adding from 2 wt. % to 3 wt. % C (carbon),
- adding at least 20 wt. % red mud,
- optionally, adding from 2 wt. % to 3 wt. % C (carbon),
- melting from 10 to 30 minutes the raw material for obtaining melt,
- optionally, adding from 2 wt. % to 3 wt. % C (carbon),
- adding at least 20 wt. % red mud,
- optionally adding from 1 wt. % to 3 wt. % C (carbon),
- melting as long as the material is looking ready molten metal, and
- forming solid metal from the melted materials.

The method can further comprise the following step:

analyzing aluminum content from the melted material, and adjusting aluminum content of the melted material by using the analyzed result.

The method for manufacturing cast iron comprising metallic raw material can comprise the following steps:

first adding metallic raw material comprising from 80 wt. % to 99 wt. % iron (Fe) containing waste material, and 0.3 wt. % to 1.5 wt. % carbon, and/or 0.3 wt. % to 1.8 wt. % graphite to the furnace then applying direct current through the at least one top electrode to provide an arc to melt the raw material, melting the raw material, preferably from 10 to 20 minutes, optionally, adding sand, preferably from 1 wt. % to 3 wt. %, melting the raw material for obtaining melt, preferably from 25 min to 60 minutes, removing at least part of the slag 201, optionally adding aluminum, preferably from 0.3 wt. % to 0.7 wt. % calculated from total mass of the raw materials on the furnace, and melting the added aluminum, preferably from 3 to 8 minutes, optionally, taking a sample of the molten material to measure an aluminum content.

The melting time of added aluminum is preferably less than 10 minutes, most preferably from 3 min to 8 min, depending on the properties of the molten metal (mainly total weight and temperature of the molten metal). If the melting time of the aluminum is more than 8 minutes, particularly more than 10 minutes, the aluminum may not be usable anymore.

Thus, the method can further comprise the following steps:

analyzing aluminum content from the melted material, and adjusting aluminum content of the melted material by using the analyzed result.

In an embodiment, the amount of aluminum is preferably controlled so that the aluminum content of the produced cast iron is at between 0.2 wt. % and 0.4 wt. %.

Thanks to the present solution, cast iron having improved properties can be manufactured with a good production efficiency. The cast iron and cast steel manufactured according to the novel solution can comprise aluminum. Thanks to the aluminum, the process can be stabilized. Further, the manufactured solid metal can have improved strength properties.

Conventionally, aluminum has not been industrially used due to process problems causing decreased properties for the manufactured metals. Thanks to the novel solution, aluminum can be added to the furnace to obtain cast iron and steel with improved properties. The aluminum used according to the novel solution can form Fe-AL-C carbides, improving strength properties of the cast metal.

As discussed above, the DC electric arc furnace 100 can comprise a bottom electrode 115. The bottom electrode 115 can be made of copper. The bottom electrode 115 is preferably in the form of one or several bottom water-cooled electrodes. The bottom electrode 115 may have a undirect connect into the working melting space of the bath.

Non-equilibrium temperature field of the melting bath 111 of the DC electric arc furnace 100, i.e., the melting bath 111 having different temperatures within its volume, can increase the purity of recoverable metals without purging with gases, as well as reduce the carbon content from the melt to 0.001%.

In an advantageous embodiment, a carbon content of the melt to be poured to a mold is around 0.001%.

As discussed above, aluminum can be added into the melting bath of the DC electric arc furnace. A percentage of aluminum from 0.2 to 30 percent of the weight of the liquid melt can increase electrolyte conductivity. The increase in the electrical conductivity of the melt can have an effect of an arc, which can influence the melt.

The melt can comprise at least iron (Fe) extracted from metallic raw materials. In this case, the increase in the electrical conductivity of the iron melt can have an effect of an arc, which can influence the melt. Thus, the required matrix, structure and ferroaluminum can be obtained without the formation of aluminum oxide films.

An increased electrolyte conductivity can influence the arc. Therefore, it can be possible to obtain molten iron in order to produce cast iron with improved properties, i.e., the super cast iron, having equal or more than 90 percent pearlite or martensitic matrix in castings of ferroaluminum in ingots. To obtain from 90% to 100% pearlite matrix it can be necessary to add from 0.2% to 0.6% of aluminum, and for a martensitic matrix it can be necessary to add from 0.6% to 1.5% of aluminum to the molten metal 202.

For ferroaluminum, it can be necessary to add from 1.5% to 30% of Al to the molten metal. The amount of Al added to the molten metal depends on the manufactured metal. Preferably, from 5 wt. % to 25 wt. %, more preferably from 8 wt. % to 20 wt. % aluminum is added to the melting space of the bath of the furnace, calculated from total weight of melt in the furnace. This can have an improvement on the direct current of the furnace. An increase in the conductivity of the molten iron due to the introduction of aluminum simultaneously with an increase in the electrolytic effect of the arc, can reduce the current supplied to the arc by 20%. This can reduce energy consumption and improve production efficiency.

Further, the cast iron having improved properties, i.e., the super cast iron, can be produced with one hundred percent pearlitic or martensitic matrix in casting or ferroaluminum in ingots Conventionally, for example aluminum may have been difficult to use for the process, because temperature of the aluminum will easily increase too much, hence, parts of aluminum may boil/exploit and cause poor properties for the product.

The DC electric arc furnace 100 can be designed and manufactured for having a low value of reactance so that the DC electric arc furnace can operate within low voltages from 20 V to 120 V, preferably equal to or less than 110 V, and high rectified current mainly from 1.0 kA to 10.0 kA.

Further, the DC electric arc furnace 100 can have a relatively high moving speed of the top electrodes, advantageously from 10 meters per minute to 15 meters per minute. Thus, each of the top electrodes preferably has their own speed, changing most of the time from 10 to 15 meters per minute.

To create conditions of the predominance of the rate of direct extraction of metals from the metal-containing raw materials, including oxide and hydroxide forms in the form of pyrite cinders, slags, "red" mud, scale, chaff, sludge and other dust-like, fine and lumpy wastes, over the melting rate of the metal-containing raw materials, which is an important condition for one hundred percent direct extraction of the metals from oxides, hydroxides of iron-containing raw materials to the source metal, the device is made in the form of a DC electric arc furnace 100, on the supply network. A steady, long-term, trouble-free operation can be created with increased power factor and electrical efficiency with single overloads from 1.0 kA to 16 kA and more for 0.6 seconds and with peak values of current up to 40 kA and more on "short" arc at the low rectified voltages from 20 V to 120 V and with a great value of strength of rectified current from 1.0 kA to 10.0 kA and more. The power-supply source can be made as a set consisting of two interlocked converter transformers with paralleling reactor, the input current-limiting reactor 170 and two diode rectifiers connected in parallel and in sets of one or several rows for one or several graphite electrodes in one or more sets in a row. The number of electrodes in the sets and the number of rows of electrodes can depend on the capacity, tonnage and power of the device.

Thus, continuous process of extracting the metals from technogenic fine oxide and hydroxide metal-containing raw materials into the original metal can be ensured, as well as reducing the negative impact of the operation of the device The cast iron manufactured according to the novel method can comprise after casting, without hardening treatment a tensile strength from 600 MPa to 1200 MPa, and/or a relative elongation from 1.5 to 3.5%, and/or HBV hardness from 150 to 280.

The cast iron manufactured according to the novel method can comprise, after a hardening treatment a tensile strength from 1400 MPa to 2200 MPa, and/or a relative elongation from 7 to 13%, and/or HRC hardness from 40 to 60.

The properties can be measured according to the following standards:

ISO 6892-1 and ISO 6892-2,

ASTM E8/E8 M-13, and

JIS Z 2241.

The novel solution can also be used to obtain special Fe metals, alloys, steel and copper metals. It can further be used for recycling of waste materials comprising metals. Particularly, the novel solution can be suitable for obtaining valuable materials from waste materials comprising metals, such as from mining waste or electronic waste.

As discussed above, the metallic raw material comes to liquid state, i.e., molten metal, during the manufacturing process. Typically, classical melting furnaces at modern metallurgical plants have been technologically incapable of smelting industrial volumes and, moreover, utilizing fine-dispersed waste. Thanks to the novel solution, a furnace capable of processing many types of fine waste and materials right at their storage and disposal sites can be provided.

The molten metal can be processed in the DC electric arc furnace to usable end products, such as metal castings. For example, the novel solution can be used to obtain fine grain microstructure, hence, the manufactured metal can be a forged like product right after casting.

In an advantageous embodiment, low carbon steel, cast iron, or ferroaluminum is manufactured from metallic raw material comprising at least 40 wt. % bauxite processing waste.

In an advantageous embodiment, low carbon steel, cast iron, or ferroaluminum is manufactured from raw material comprising at least 50 wt. % pyrite cinder, i.e., waste generated during the processing of iron pyrites.

In an advantageous embodiment, low carbon steel, cast iron or ferroaluminum is manufactured from raw material comprising at least 40 wt. % waste of gas and gas cleaning of metallurgical and steel production.

In an advantageous embodiment, ferronickel is manufactured from raw material comprising at least 50 wt. % nickel-containing sludge and/or Ni—Fe and/or Ni—Cd battery lamellas.

Furthermore, thanks to the novel solution, bound moisture content in sludge, particularly in nickel-containing waste, can be up to 50% without a need of a separate drying step.

In an advantageous embodiment, purge gases are not used to reduce the carbon content during the manufacturing process of a metal.

The method for manufacturing metals according to the novel solution does not need to have a step, wherein a removal of high carbon from the melt is carried out in the smelting process by gas blowing.

The capacity of the DC electric arc furnace can be selected for the current need. A capacity of the arc furnace 100 can be, for example, from 0.01 to 12 tons, typically from 2 tons to 12 tons.

Cast iron manufactured according to the novel solution can have a very fine-grained structure in castings with strength in gray cast iron up to 600 MPa, for example from 500 MPa to 600 MPa and hardness up to 230 HB, for example from 200 to 230 HB.

Parts made of such cast iron can be, but not necessarily need to be, hardened volumetric or locally in thermal furnaces and high-frequency currents (HDTV-hardening) to a hardness of 55 HRC and strength up to 1500 MPa with a change in the microstructure from pearlite up to 100% martensite.

Example 1

A cast iron having improved properties, i.e., a super cast iron, was manufactured as follows:

first adding metallic raw material comprising
around 98 wt. % Fe containing waste material,
around 0.5 wt. % carbon, and
around 0.5 wt. % graphite
to the DC electric arc furnace, then applying direct current through three top electrodes to provide an arc to melt the raw material, melting around 15 minutes the metallic raw material, adding around 1 wt. % sand, melting around 30 to 60 minutes the raw material, thereby obtaining melt, removing at least part of the slag, adding from 0.3 wt. % to 0.7 wt. % aluminum, calculated from total mass of the raw materials on the furnace, melting around 5 minutes to melt the added aluminum, and taking a sample of the molten material, the amount of the aluminum was around 0.3 wt. %.

The manufactured metal was analyzed. There solid metal comprised

C 2.90 wt. %,
Si 2.11 wt. %,
Mn 0.61 wt. %,
S 0.014 wt. %,
P 0.028 wt. %,
Cu 0.43 wt. %,
Mg<0.010 wt. %,
Al 0.3 wt. %, and
up to 100 wt. % Fe.

The cast iron, after smelting in the furnace, had such a fine-grained microstructure that it did not require further forging process. The product was called as a super cast iron due to the improved properties and microstructure.

Example 2

A cast iron manufactured according to the novel solution was tested before and after a heat treatment. Raw materials consisted of 7 wt. % aluminum, around 90 wt. % waste metals and up to 3 wt. % other components, mainly carbon containing components. The cast iron, i.e., the super cast iron, manufactured according to the novel solution had great, improved properties as shown in Table 1.

TABLE 1

| | Tensile strength (N/mm2) | 0.2% proof stress (N/mm2) | Elon-gation (%) | Brinell hardness range hbw | Hard-ness hrc |
|---|---|---|---|---|---|
| PROPERTIES AFTER CASTING | | | | | |
| SCI600 | 600 | 370 | 3 | 190 . . . 240 | |
| SCI700 | 700 | 420 | 2 | 200 . . . 250 | |
| SCI800 | 800 | 800 | 2 | 210 . . . 260 | |
| PROPERTIES AFTER MANTENSITE HARDNENING | | | | | |
| SCI-1500-H | 1500 | 1500 | 9 | ~486* | 50 |
| SCI-1600-H | 1600 | 1600 | 10 | ~557* | 55 |
| SCI-2000-H | 2000 | 2000 | 11 | ~642* | 60 |

Example 3

A cast iron was manufactured as follows:
first adding metallic raw material comprising
around 20 wt. % Fe containing waste material
around 1 wt. % C,
around 1 wt. % graphite, and
around 1 wt. % sand
to the DC electric arc furnace
then applying direct current through the at least one top electrode to provide an arc to melt the raw material,
melting the raw material,
removing at least part of the slag,
adding around 2.5 wt. % carbon,
adding around half of red mud,
adding around 2.5 wt. % carbon,
melting around 25 minutes the raw material, thereby obtaining melt,
adding around 2.5 wt. % carbon,
adding the other half of the red mud,
adding around 2 wt. % carbon,
melting as long as the material was looking ready
The total duration of the batch process took around 1 hour.
Two material batches were manufactured. The results were lightly dependent on the waste raw material.
The first batch consisted of (wt. %)
C 2.90,
Si 2.11,
Mn 0.61,
S 0.014,
P 0.028,
Cu 0.43,
Mg<0.010, and
Fe.
The second batch consisted of
C 3.6,
Si 1.3,
Mn 0.6,
S 0.1,
P 0.2,
Cr 0.07,
Ni 0.0,
Mo 0.37,
Ti 0.01,
Cu 0.22, and
Fe.

Example 4

A new material patch was manufactured almost according to the Example 2, but around 14 wt. % aluminum, calculated from total mass of the raw materials, was added to the melt, after which the added aluminum was heated around 6 minutes in order to melt the added aluminum.
The cast iron was tested and consisted of
C 2.57 wt. %,
Si 0.98 wt. %,
Mn 0.51 wt. %,
S 0.05 wt. %,
P 0.2 wt. %,
Cr 0.1 wt. %,
Ni 0.08 wt. %,
Cu 0.37 wt. %,
Ti 0.11 wt. %,
Al 10.6 wt. %,
up to 100 wt. % Fe.
Thermophysical characteristics of the obtained FA10 cast iron were:
Melting point of FA10 cast iron samples was between 1490° C. and 1500° C.,
Structural phase component—$Fe_6Al$
Density was around 6.5 g/cm$^3$
Aluminum content was around 10 wt. %

Example 5

A steel comprising mainly red mud as a metal containing raw material was manufactured according to the novel solution. Iron was recovered from the red mud and converted directly to steel. There was no need for further processing to obtain steel from the red mud.
Thanks to the novel solution, only 50 kg $CO_2$/produced metal ton was generated. Typically, converting waste raw material to usable metals produces around 1900 kg $CO_2$/produced metal ton. Thus, the novel solution was able to decrease the effect of the manufacturing process on the environment. Further, low quality raw material (red mud) was used to obtain high quality product.

Example 6

An abrasiveness of the novel solution was tested by using a DC electric arc furnace. Solid metals were manufactured almost every day according to the novel solution. Due to the novel solution, refractory materials were in good condition still after 3 months.
Thanks to the novel solution, it can be possible to recycle metal-containing waste. The novel solution may be used with different kind of metallic waste raw materials, such as red mud, pyrite cinder, nickel-containing slags and copper-containing sludge, iron scale, chromite sand waste, waste products and gas cleaning of steel melts, iron dust, recycled gas and chromite sands, waste products and gas cleaning of steel melts, waste iron scrap, gas cleaners, chromite sand, wastes, dust and gas purification of steel melts, iron scales, chromite sands, waste products, gas cleaners, or electronic scrap.

Furthermore, it can be possible to obtain a market product in the form of steel or cast-iron ingots, slabs, copper billets, ferroaluminum, ferronickel, alloyed steels and cast iron at the exit of the furnace.

The novel method can provide a process having very good production efficiency due to decreased power consumption. A decrease in power consumption can be very important, not only for a production efficiency, but also for environmental reasons.

Further, the novel method can provide low $CO_2$ emissions together with decreased power consumption, hence, it can be environmentally friendly solution. Still further, toxins can be removed in the novel process. Therefore, the present solution can be environmentally friendly due to low $CO_2$ emissions, ability to remove toxins and improved energy transfer. Further, metals can be recovered from materials that are typically considered waste or environmentally hazardous. However, the novel solution can be used almost anywhere, where the problematic metallic raw materials needs to be processed.

The solution can provide an efficient use of allows. For example, low carbon steels and alloys can be smelt. Further, very high metal recovery rate from 75% up to 99.5% can be obtained. Thus, some advantages of the novel solution can be environmental friendliness, profitability and, most importantly, its multifunctionality, since the technology can be used to process various wastes depending on the needs of the customer.

The invention claimed is:

1. A method for extracting metal from metal-containing raw material in a batch process by using a direct current electric arc furnace having at least two top electrodes and at least one bottom electrode, wherein the method comprises the following steps:

adding the metal-containing raw material to the furnace, thereby obtaining a loaded bath, moving the top electrodes on to the raw material, heating the loaded bath in a heating step by applying direct current through the top electrodes to provide an arc to melt the raw material, thereby obtaining molten metal, wherein each top electrode has an average voltage during the heating step from 20 V to 110 V, and wherein the at least two top electrodes have, during the heating step, an average speed from 5 m/min to 20 m/min, and forming solid metal from the molten metal, wherein the at least two top electrodes comprise a first top electrode and a second top electrode, and the first top electrode has a first speed, and the second top electrode has a second speed, and the method further comprises:

controlling the heating step by moving the first top electrode with the first speed differing from the second speed of the second top electrode.

2. The method according to claim 1, wherein the method further comprises adding aluminum to the molten metal, and heating the molten metal comprising the aluminum before forming the solid metal.

3. The method according to claim 1, wherein the method comprises the following steps:

analyzing aluminum content from the molten metal, and adjusting aluminum content of the molten metal by using the analyzed result.

4. The method according to claim 1, wherein the voltage is from 50 V to 100 V at least 60% of duration of the heating step.

5. The method according to claim 1, wherein a carbon content of the molten metal is equal to or less than 0.01 wt.-%.

6. The method according to claim 1, wherein the method comprises adding from 0.2 wt. % to 15.0 wt.-% carbon and/or adding from 0.2 wt. % to 15.0 wt.-% graphite to the metal containing raw material before forming the solid metal.

7. The method according to claim 1, wherein the metal containing raw material comprises finely dispersed material having a particle size equal to or less than 1 mm, the amount of the finely dispersed material being equal to or more than 50 dry wt. %.

8. The method according to claim 1, wherein the metal containing raw material comprises equal to or more than 40 dry wt. % red mud.

9. The method according to claim 1, wherein the metal containing raw material has a moisture content between 0 wt.-% and 25 wt.-%.

10. The method according to claim 1, wherein the metal containing raw material comprises at least 40 wt. % pyrite cinder, and/or the solid metal is a ferronickel, and the metal containing raw material comprises nickel-containing sludge and/or Ni—Fe and/or Ni—Cd battery lamellas, and/or the metal containing raw material comprises waste from metallurgical and steel production.

* * * * *